US009028374B1

(12) United States Patent
Brady

(10) Patent No.: US 9,028,374 B1
(45) Date of Patent: May 12, 2015

(54) ROWING EXERCISE DEVICE

(71) Applicant: Scott P. Brady, Placentia, CA (US)

(72) Inventor: Scott P. Brady, Placentia, CA (US)

( * ) Notice: Subject to any disclaimer, the term of this patent is extended or adjusted under 35 U.S.C. 154(b) by 171 days.

(21) Appl. No.: 13/759,149

(22) Filed: Feb. 5, 2013

(51) Int. Cl.
*A63B 22/00* (2006.01)
*A63B 21/068* (2006.01)

(52) U.S. Cl.
CPC ..... *A63B 22/0076* (2013.01); *A63B 21/068* (2013.01)

(58) Field of Classification Search
USPC ..... 482/51, 71–72, 142
See application file for complete search history.

(56) References Cited

U.S. PATENT DOCUMENTS

| | | | | | |
|---|---|---|---|---|---|
| 1,707,791 | A | * | 4/1929 | Anderson | 482/72 |
| 3,892,404 | A | | 7/1975 | Martucci | |
| 4,383,684 | A | * | 5/1983 | Schliep | 482/96 |
| 4,974,832 | A | | 12/1990 | Dalebout | |
| D324,709 | S | | 3/1992 | Lehtonen | |
| 5,354,251 | A | * | 10/1994 | Sleamaker | 482/96 |
| D352,534 | S | | 11/1994 | Dreibelbis et al. | |
| 5,938,571 | A | | 8/1999 | Stevens | |

* cited by examiner

*Primary Examiner* — Stephen Crow

(57) ABSTRACT

A rowing exercise device simulates rowing including lateral pivoting movement to require control of core muscles, thus providing a more complete exercise experience. The device includes a frame having a pair of spaced supports and an elongated track coupled to and extending between the supports. A handle is coupled to the frame proximate a first end of the track. A seat is slidably coupled to the track wherein the seat is movable along the track to simulate a rowing motion. The seat is laterally pivotable relative to the track to require a user positioned on the seat to utilize core muscles to maintain balance on the seat as the seat moves along the track.

8 Claims, 4 Drawing Sheets

ROWING EXERCISE DEVICE

BACKGROUND OF THE DISCLOSURE

Field of the Disclosure

The disclosure relates to exercise devices and more particularly pertains to a new exercise device for simulating rowing including lateral movement to require control of core muscles to provide a more complete exercise experience.

SUMMARY OF THE DISCLOSURE

An embodiment of the disclosure meets the needs presented above by generally comprising a frame having a pair of spaced supports and an elongated track coupled to and extending between the supports. A handle is coupled to the frame proximate a first end of the track. A seat is slidably coupled to the track wherein the seat is movable along the track to simulate a rowing motion. The seat is laterally pivotable relative to the track to require a user positioned on the seat to utilize core muscles to maintain balance on the seat as the seat moves along the track.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
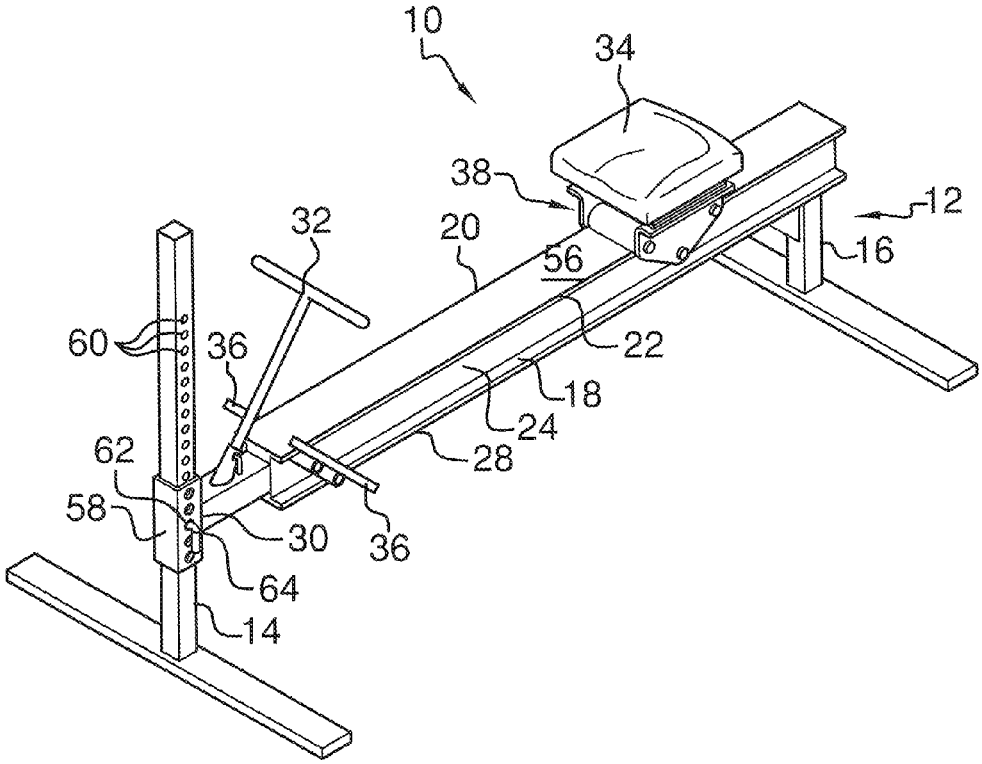
FIG. 1 is a top front side perspective view of a rowing exercise device according to an embodiment of the disclosure.
Figure 2:
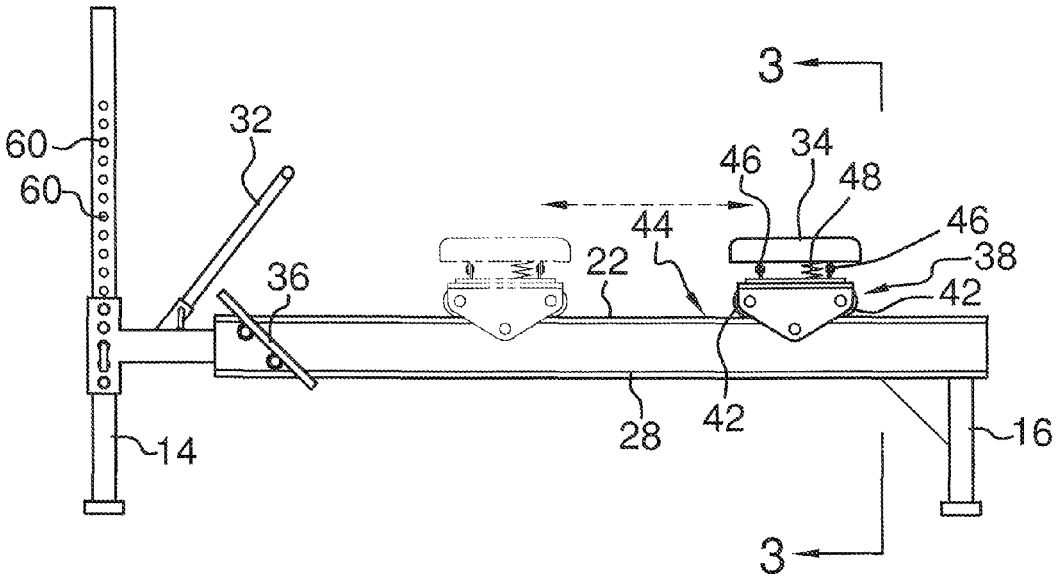
FIG. 2 is a side view of an embodiment of the disclosure.
Figure 3:
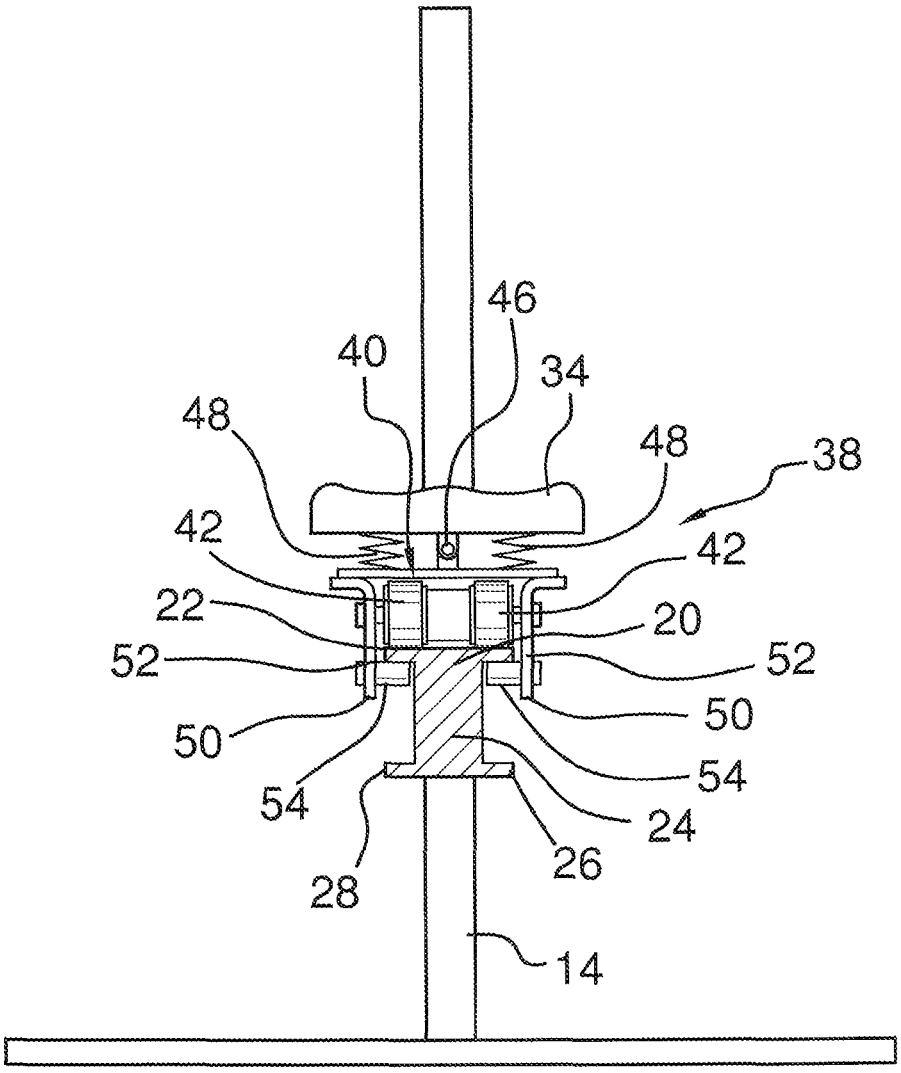
FIG. 3 is a cross-sectional view of an embodiment of the disclosure taken along line 3-3 of FIG. 2.
Figure 4:
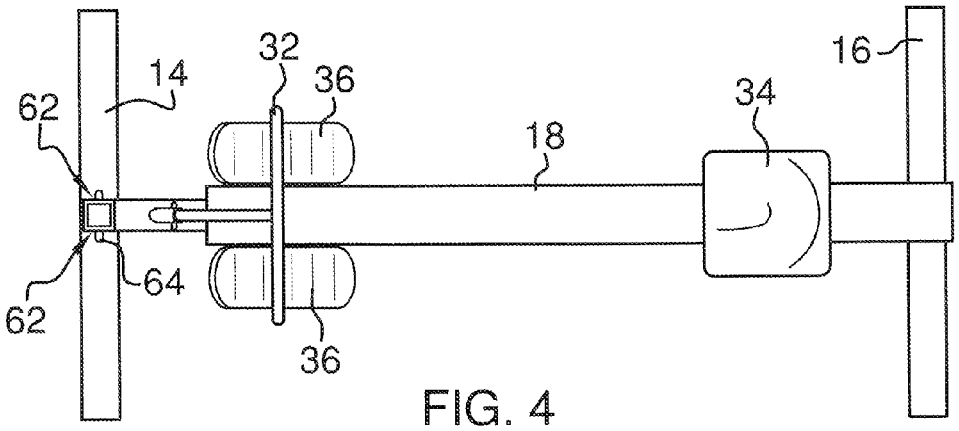
FIG. 4 is a top view of an embodiment of the disclosure.
Figure 5:
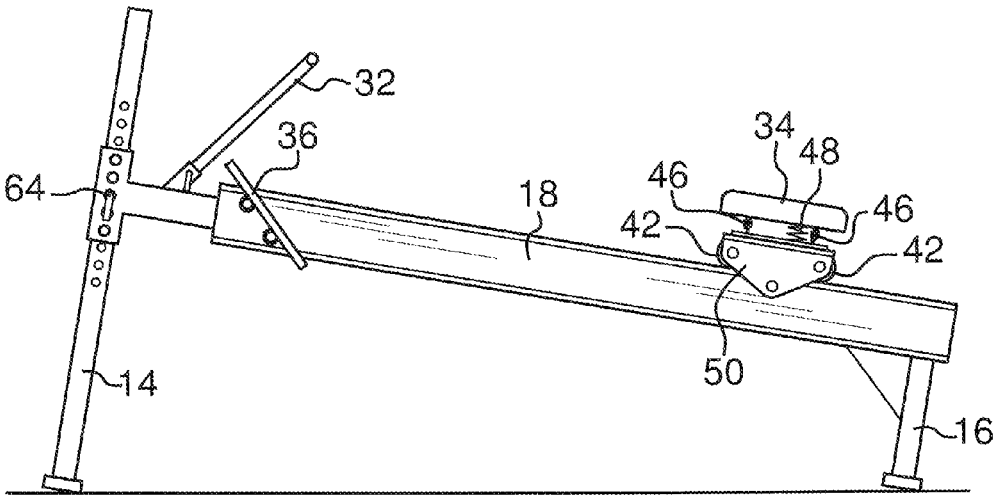
FIG. 5 is a side view of an embodiment of the disclosure in an inclined position.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the rowing exercise device 10 generally comprises a frame 12 having a pair of spaced supports 14,16 and an elongated track 18 coupled to and extending between the supports 14,16. The track 18 has a pair of flanges 20,22 extending outwardly from a central portion 24 of the track 18. The track 18 may have an additional pair of flanges 26,28 wherein said track 18 is in the form of an I-beam. A first one of the supports 14 is telescopic relative to a first end 30 of the track 18. Thus, inclination of the track 18 is adjustable to increase gravitational resistance to exercise described below. A handle 32 is coupled to the frame 12 and positioned proximate the first end 30 of the track 18. A seat 34 is slidably coupled to the track 18 wherein the seat 34 is movable along the track 18. The seat 34 is laterally pivotable relative to the track 18 to require a user positioned on the seat 34 to utilize core muscles to maintain balance on the seat 34 as the seat 34 moves along the track 18. A plurality of foot rests 36 is coupled to the frame 12. Each foot rest 36 is positioned on an associated side of the track 18 proximate the first end 30 of the track 18.

The seat 34 is coupled to the track 18 using a seat base 38 coupled to the seat 34 and the track 18. The seat base 38 having a planar upper surface 40. A plurality of rollers 42 is coupled to the seat base 38. The rollers 42 rest on a surface 44 of the track 18 wherein the seat base 38 is slidable along the track 18. A pair of spaced aligned hinges 46 is coupled to and extends between the planar upper surface 40 of the seat base 38 and the seat 34 wherein the seat 34 is pivotally coupled to the seat base 38. The hinges 46 are aligned with the track 18. A plurality of biasing members 48 is also coupled to and extends between the seat 34 and the seat base 38. The biasing members 48 are positioned in lateral spaced relationship to the hinges 46. Thus, the biasing members 48 provide some resistance to lateral pivoting movement of the scat 34 relative to the track 18.

A pair of lateral sections 50 are incorporated into the seat base 38. Each lateral section 50 extends downwardly adjacent to a distal edge 52 of an associated one of the flanges 20,22 wherein the lateral sections 50 of the seat base 38 inhibit lateral movement of the seat base 38 relative to the track 18. Each of a pair of extensions 54 is coupled to and extends from an associated one of the lateral sections 50 of the seat base 38. Each extension 54 is positioned adjacent to a surface 56 of an associated one of the flanges 20,22 of the track 18 such that the associated flange 20,22 extends between an associated one of the rollers 42 and the associated extension 54. Each side of the seat base 38 may incorporate a pair of the rollers 42 spaced parallel to the track 18 and a single extension 54 positioned beneath the associated flange 20,22 and between the rollers 42. Thus, the extensions 54 are configured to prevent vertical movement of the seat base 38 relative to the track 18.

A collar 58 is coupled to the first end 30 of the track 18. The first one of the supports 14 is elongated and extends through the collar 58. A plurality of locking apertures 60 extend through the first one of the supports 14. The locking apertures 60 are arranged in spaced relationship along a length of the first one of the supports 14. A pair of aligned holes 62 extend through the collar 58. The aligned holes 62 are alignable with a selectable one of the locking apertures 60 when the first one of the supports 14 is extended through the collar 58. A locking pin 64 is insertable through the aligned holes 62 and the selectable one of the locking apertures 60 whereby the first one of the supports 14 is secured in a static position relative to the track 18.

In use, the user adjusts the first one of the supports 14 for a desired inclination of the track 18. The user then sits upon the seat 34 and utilizes the handle 32 and foot rests 36 to move back and forth along the track 18. Core muscles of the user are required to maintain balance of the user on the seat 34 as the user exercises.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A rowing exercise device comprising:

a frame having a pair of spaced supports and an elongated track coupled to and extending between said supports;

a handle coupled to said frame, said handle being positioned proximate a first end of said track;

a seat slidably coupled to said track wherein said seat is movable along said track, said seat being laterally pivotable relative to said track wherein said seat is configured for requiring a user positioned on said seat to utilize core muscles to maintain balance on said seat as said seat moves along said track;

a seat base coupled to said seat and said track, said seat base having a planar upper surface, said seat being pivotally coupled to said seat base;

a plurality of rollers coupled to said seat base, said seat rollers resting on a surface of said track wherein said seat base is slidable along said track;

a plurality of biasing members coupled to and extending between said seat and said seat base wherein said biasing members provide resistance to lateral movement of said seat relative to said track; and a pair of spaced aligned hinges coupled to and extending between said planar upper surface of said seat base and said seat, each of said biasing members being positioned in spaced relationship to said aligned hinges.

2. The device of claim 1, further comprising a plurality of foot rests coupled to said frame, each foot rest being positioned on an associated side of said track.

3. The device of claim 1, further comprising:

said track having a pair of flanges extending outwardly from a central portion of said track; and said seat base having a pair of lateral sections, each lateral section extending downwardly adjacent to a distal edge of an associated one of said flanges wherein said lateral section of said seat base inhibit lateral movement of said seat base relative to said track.

4. The device of claim 3, further comprising a pair of extensions, each extension being coupled to and extending from an associated one of said lateral sections of said seat base, each extension being positioned adjacent to a surface of an associated one of said flanges of said track such that said associated flange extends between an associated one of said rollers and said associated extension wherein said extensions are configured to prevent vertical movement of said seat base relative to said track.

5. The device of claim 1, further comprising a first one of said supports being telescopic relative to said first end of said track wherein inclination of said track is adjustable.

6. The device of claim 5, further comprising:

a collar coupled to said first end of said track; and said first one of said supports being elongated and extending through said collar.

7. The device of claim 6, further comprising:

a plurality of locking apertures extending through said first one of said supports, said locking apertures being arranged in spaced relationship along a length of said first one of said supports;

a pair of aligned holes extending through said collar, said aligned holes being alignable with a selectable one of said locking apertures when said first one of said supports is extended through said collar; and a locking pin insertable through said aligned holes and said selectable one of said locking apertures wherein said first one of said supports is secured in a static position relative to said track.

8. A rowing exercise device comprising:

a frame having a pair of spaced supports and an elongated track coupled to and extending between said supports, said track having a pair of flanges extending outwardly from a central portion of said track, a first one of said supports being telescopic relative to said first end of said track wherein inclination of said track is adjustable;

a handle coupled to said frame, said handle being positioned proximate a first end of said track;

a seat slidably coupled to said track wherein said seat is movable along said track, said seat being laterally pivotable relative to said track wherein said seat is configured for requiring a user positioned on said seat to utilize core muscles to maintain balance on said seat as said seat moves along said track;

a plurality of foot rests coupled to said frame, each foot rest being positioned on an associated side of said track;

a seat base coupled to said seat and said track, said seat base having a planar upper surface;

a plurality of rollers coupled to said seat base, said seat rollers resting on a surface of said track wherein said seat base is slidable along said track;

a pair of spaced aligned hinges coupled to and extending between said planar upper surface of said seat base and said seat wherein said seat is pivotally coupled to said seat base;

a plurality of biasing members coupled to and extending between said seat and said seat base wherein said biasing members provide resistance to lateral movement of said seat relative to said track, each of said biasing members being positioned in spaced relationship to said aligned hinges;

a pair of lateral sections of said seat base, each lateral section extending downwardly adjacent to a distal edge of an associated one of said flanges wherein said lateral section of said seat base inhibit lateral movement of said seat base relative to said track;

a pair of extensions, each extension being coupled to and extending from an associated one of said lateral sections of said seat base, each extension being positioned adjacent to a surface of an associated one of said flanges of said track such that said associated flange extends between an associated one of said rollers and said associated extension wherein said extensions are configured to prevent vertical movement of said seat base relative to said track;

a collar coupled to said first end of said track, said first one of said supports being elongated and extending through said collar;

a plurality of locking apertures extending through said first one of said supports, said locking apertures being arranged in spaced relationship along a length of said first one of said supports;

a pair of aligned holes extending through said collar, said aligned holes being alignable with a selectable one of said locking apertures when said first one of said supports is extended through said collar; and a locking pin insertable through said aligned holes and said selectable one of said locking apertures wherein said first one of said supports is secured in a static position relative to said track.

* * * * *